US012607027B2

(12) United States Patent
Atkinson

(10) Patent No.: US 12,607,027 B2
(45) Date of Patent: Apr. 21, 2026

(54) OVERFLOW SYSTEM FOR RECREATIONAL POOLS

(71) Applicant: COM PAC FILTRATION, INC., Jacksonville, FL (US)

(72) Inventor: Dean M. Atkinson, Jackonsville, FL (US)

(73) Assignee: COM PAC FILTRATION, INC., Jacksonville, FL (US)

( * ) Notice: Subject to any disclaimer, the term of this patent is extended or adjusted under 35 U.S.C. 154(b) by 179 days.

(21) Appl. No.: 18/662,022

(22) Filed: May 13, 2024

(65) Prior Publication Data

US 2024/0376735 A1 Nov. 14, 2024

Related U.S. Application Data

(60) Provisional application No. 63/501,751, filed on May 12, 2023.

(51) Int. Cl.
*E04H 4/12* (2006.01)

(52) U.S. Cl.
CPC ..... *E04H 4/1245* (2013.01); *E04H 4/1236* (2013.01); *E04H 4/1281* (2013.01)

(58) Field of Classification Search
CPC ... E04H 4/1236; E04H 4/1245; E04H 4/1281; E04H 4/1209; E04H 4/12
See application file for complete search history.

(56) References Cited

U.S. PATENT DOCUMENTS

| | | | | |
|---|---|---|---|---|
| 270,293 | A * | 1/1883 | Ennis | E04H 4/1236 4/507 |
| 3,386,107 | A | 6/1968 | Whitten, Jr. | |
| 3,815,160 | A | 6/1974 | Baker | |
| 4,206,522 | A | 6/1980 | Baker | |
| 4,498,984 | A * | 2/1985 | Colson | E04H 4/12 4/508 |
| 4,997,558 | A * | 3/1991 | Baker | E04H 4/1209 210/143 |
| 5,566,706 | A * | 10/1996 | Harpenau | E04H 4/12 137/142 |
| 10,344,466 | B2 | 7/2019 | Kent | |
| 11,071,259 | B2 | 7/2021 | Mcclain | |
| 2023/0057876 | A1 | 2/2023 | Fischmann | |
| 2023/0249986 | A1 | 8/2023 | Fischmann | |

* cited by examiner

*Primary Examiner* — Erin Deery
(74) *Attorney, Agent, or Firm* — ALLEN, DYER, DOPPELT + GILCHRIST, P.A.

(57) ABSTRACT

An overflow system for a recreational pool includes a drain configured to be mounted to a bottom of the recreational pool, and a drain pipe configured to extend substantially horizontally from the drain under a perimeter wall defining a boundary of the recreational pool to outside the boundary. The system also includes a standpipe configured to be positioned outside the boundary and having a first end and an open second end. The first end is coupled to the drain pipe and the second open end has an overflow elevation between a normal water level elevation for the recreational pool and a top of wall elevation of the perimeter wall. In addition, the system includes a recirculation pipe having a first end in fluid communication with the recreational pool and a second end in fluid communication with the standpipe proximate the second open end.

20 Claims, 2 Drawing Sheets

OVERFLOW SYSTEM FOR RECREATIONAL POOLS

CROSS-REFERENCE TO RELATED APPLICATIONS

This application claims the benefit of U.S. provisional application No. 63/501,751 filed May 12, 2023, which is hereby incorporated herein in its entirety by reference.

FIELD OF THE INVENTION

The present invention relates to pools and more particularly to an overflow system for recreational pools.

BACKGROUND

Large pools, such as those found in water parks or recreational facilities, typically have built-in overflow systems designed to manage excess water during heavy rainfall. For example, many large pools are equipped with overflow channels or gutters around the perimeter. These channels collect excess water and direct it to drainage systems, preventing overflow. The channels are usually located slightly below the edge of the pool to capture any overflowing water. In addition to overflow channels, large pools often have drainage systems installed to handle excess water. These systems may include underground pipes connected to the overflow channels, which carry the water away from the pool and discharge it into a stormwater management system or natural water bodies. Some pools are equipped with variable water level controls that automatically adjust the water level in response to rainfall. These systems may use sensors to detect changes in water level and adjust the flow rate of water entering the pool accordingly, helping to maintain a consistent water level and prevent overflow. In some cases, large pools may be designed with adjacent retention basins or reservoirs to capture excess water during heavy rainfall. These basins temporarily store the overflow water and gradually release it back into the environment once the rainfall subsides, reducing the risk of overflow from the pool itself.

However, there is a need to further develop overflow systems so that large pools can more effectively manage excess water and prevent overflow during rainy weather, ensuring the aesthetics, safety and functionality of the facility.

SUMMARY

An overflow system for a recreational pool is disclosed. The overflow system includes a drain configured to be mounted to a bottom of the recreational pool, and a drain pipe configured to extend substantially horizontally from the drain under a perimeter wall, which defines a boundary of the recreational pool, to outside the boundary. The system also includes a standpipe configured to be positioned outside the boundary and having a first end and an open second end. The first end is coupled to the drain pipe and the second open end has an overflow elevation between a normal water level elevation for the recreational pool and a top of wall elevation of the perimeter wall. In addition, the system includes a recirculation pipe having a first end in fluid communication with the recreational pool and a second end in fluid communication with the standpipe proximate the second open end.

The recirculation pipe is configured to cause water to circulate from the recreational pool to the standpipe and through the drain pipe back to the recreational pool to prevent stagnation of the water in the drain pipe when a water level in the recreational pool is at the normal water level or below. In addition, the system is configured to cause the water from the recreational pool to flow through the drain pipe and out the second end of the standpipe that is positioned outside of the boundary of the recreational pool when the water level in the recreational pool rises above the normal water elevation.

The overflow system may also include a pump in fluid communication with the recirculation pipe and configured to pump water from the recreational pool to the standpipe. The overflow system may also include an overflow basin housing the standpipe, and a discharge pipe in fluid communication with the overflow basin.

In another aspect, a recreational pool is disclosed. The recreational pool includes a perimeter wall defining a boundary for the recreational pool, where the perimeter wall has a top of wall elevation above a normal water level elevation of the recreational pool. The recreational pool also includes an overflow system as described above.

In another aspect, a method of controlling an overflow system for a recreational pool is disclosed where the recreational pool includes a perimeter wall defining a boundary and having a top of wall elevation above a normal water level elevation of the recreational pool. The method includes mounting a drain to a bottom of the recreational pool, extending a drain pipe substantially horizontally from the drain under the perimeter wall to outside the boundary, and positioning a standpipe outside the perimeter wall. The standpipe has a first end and an open second end where the first end is coupled to the drain pipe and the second open end of the standpipe has an overflow elevation set between the normal water level elevation for the recreational pool and the top of wall elevation. The method also includes coupling a recirculation pipe having a first end in fluid communication with the recreational pool and a second end in fluid communication with the standpipe proximate the second open end, and circulating water from the recreational pool to the standpipe and through the drain pipe back to the recreational pool using the recirculation pipe. The circulation prevents stagnation of the water in the drain pipe when a water level in the recreational pool is at the normal water level or below.

BRIEF DESCRIPTION OF THE DRAWINGS

The above objects, as well as additional objects, features and advantages of the present invention, will be more fully appreciated by reference to the following illustrative and non-limiting detailed description of embodiments of the present invention, when taken in conjunction with the accompanying drawings, wherein.

DETAILED DESCRIPTION

In the present detailed description, embodiments of the present invention will be discussed with the accompanying figures. It should be noted that this by no means limits the scope of the invention, which is also applicable in other circumstances for instance with other types or variants of methods other than the embodiments shown in the appended drawings. Further, that specific features are mentioned in connection to an embodiment of the invention does not mean that those components cannot be used to an advantage together with other embodiments of the invention.

Figure 1:
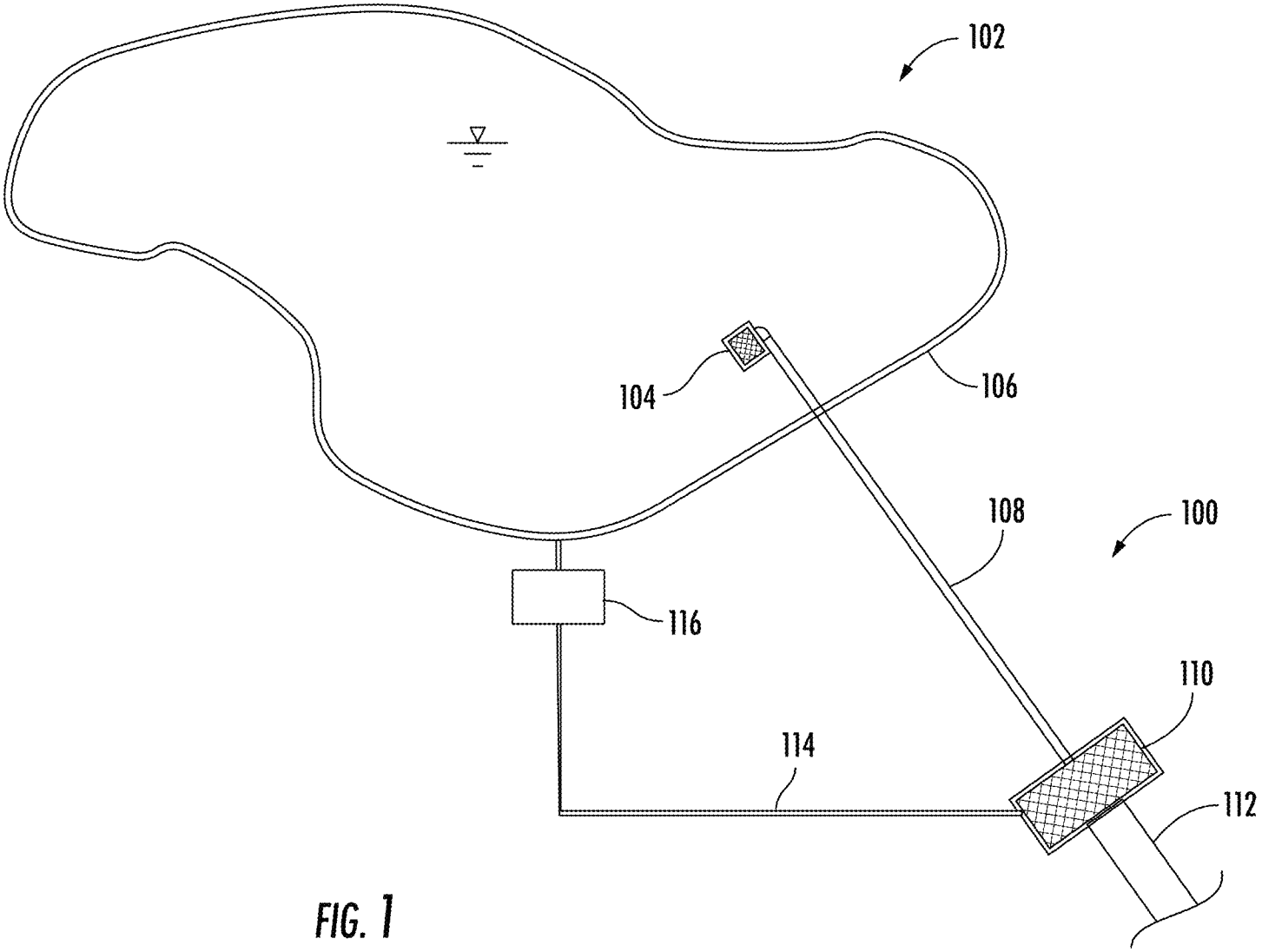
FIG. 1 is a schematic overview of an overflow system for a recreational pool in which various aspects of the disclosure may be implemented.

Referring to FIG. 1, an overflow system for a recreational pool is generally designated 100 and the recreational pool is designated 102. The overflow system 102 includes a drain 104 that is mounted to a bottom of the recreational pool 102. Accordingly, the overflow system 100 is hidden from any users of the recreational pool as the only element that is visible is the drain 104 on the bottom. This is in contrast to existing systems that position weirs within the boundary of the pool or large overflow structures within the pool itself.

The overflow system 100 includes a drain pipe 108 that extends substantially horizontally from the drain 104 under a perimeter wall 106 to an overflow basin 110. The perimeter wall 106 defines a boundary of the recreational pool 102 and the overflow basin 110 is positioned outside the boundary hidden from view. The perimeter wall 106 may be sloped or substantially vertical to form a bank for the recreational pool 102, A discharge pipe 112 is in fluid communication with the overflow basin 110 and is configured to collect water that overflows and to discharge to a nearby stream or other water body. The overflow system 100 also includes a recirculation pipe 114. The recirculation pipe 114 is configured to cause water to circulate through the drain pipe 114 and prevent the water from being stagnant even when it is not overflowing. A pump and/or chemical feed 116 may also be in fluid communication with the recirculation pipe to treat the water. In particular, the recirculation pipe 114 is configured to prevent stagnation of the water in the drain pipe 108 when a water level in the recreational pool 102 is at the normal water level or below and no water is overflowing.

For example, due to the relatively long length of the drain pipe 108, a significant volume of water could remain stagnant therein between overflow events. This could become a sanitation issue, particularly if evaporation or other causes result in a water level drop and the water from the drain pipe 108 backflows into the recreational pool 102.

The recirculation pipe 114 provides a regular backflow of treated water through the drain pipe 108 to the drain 104, preventing stagnation and undesirable micro-organism growth. The recirculation pipe 114 can take already treated water from the recreational pool 102 and introduce it into the standpipe 118 as described above. The recirculation pipe 114 can also be configured to introduce treatment chemicals directly into the water using a chemical feed 116.

Figure 2:
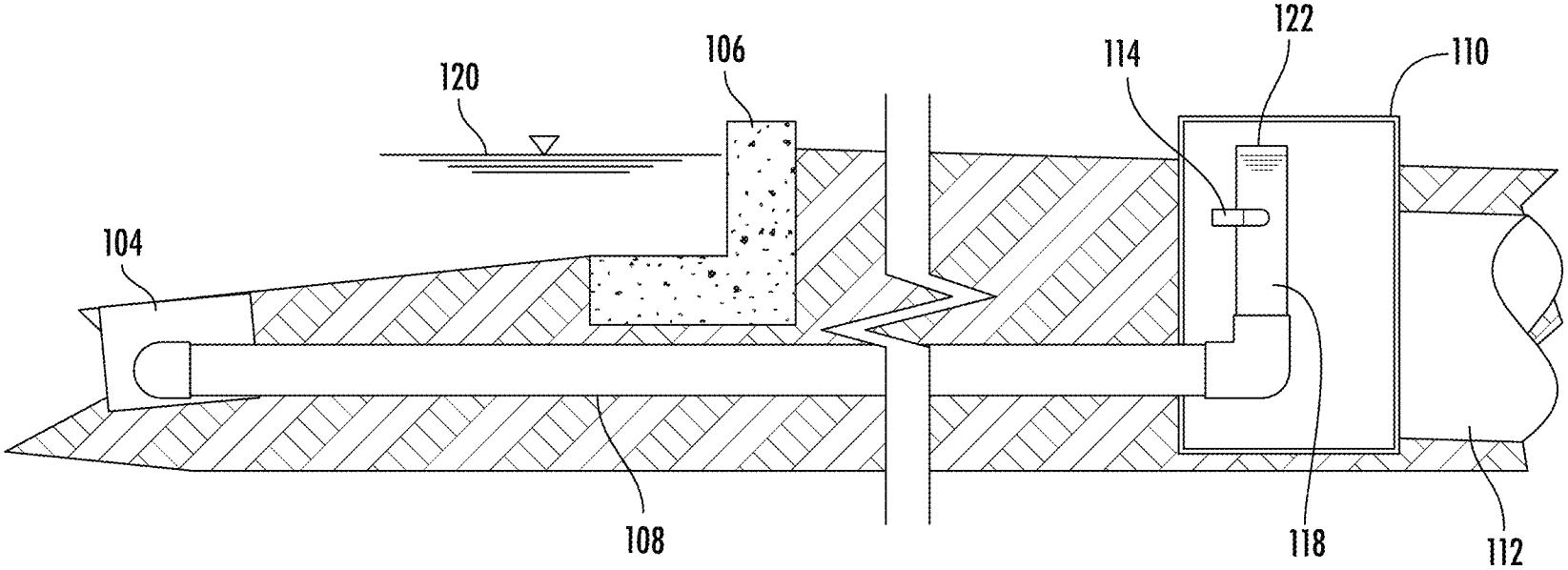
FIG. 2 is a partial sectional view of the overflow system of FIG. 1.

Referring now to FIG. 2, the overflow system 100 also includes a standpipe 118 configured to be positioned within the overflow basin 110. The standpipe 118 has a first end and an open second end. The first end of the standpipe 118 is coupled to the drain pipe 108 and the second open end 122 has an overflow elevation between a normal water level elevation 120 for the recreational pool 102 and a top of wall elevation of the perimeter wall 106.

In operation, the overflow system 100 is configured to cause the water from the recreational pool 102 to flow through the drain pipe 108 and out the second end 122 of the standpipe pipe 118 that is positioned outside of the boundary of the recreational pool 102 when the water level in the recreational pool rises above the normal water elevation 120.

The drain pipe 108 diameter is sized and selected so that hydraulic effects do not interfere with atmospheric and water pressure ensuring that the steady state water level adjacent to the open second end 122 of the standpipe 118 is substantially equal to the steady state water level, or normal water level 120, in the recreational pool 102. Generally, the required pipe diameter of the drain pipe 108 will increase with the distance between the drain 104 and the standpipe 118.

In a particular aspect, the recreational pool 102 includes the perimeter wall 106 that forms all or a portion of the boundary of the recreational pool 102. The elevation of the open second end 122 of the standpipe 118 is preferably set a predetermined distance below the elevation of the perimeter wall 106. If the elevation of the perimeter wall 106 is not consistent around the entire recreational pool 102, then the elevation of the second open end 122 of the standpipe 118 is preferably referenced to a lowest perimeter wall 106 elevation. Consequently, once water entering the recreational pool 102 causes the water level to rise to the overflow level set by the open second end 122 of the standpipe 118, any additional water entry will cause water to spill out and into the overflow basin 110 until the water level returns to the level of the open second end 122 of the standpipe 118.

The elevation of the overflow basin 110 is preferably equal to the elevation of the perimeter wall 106. The overflow basin 110 may be covered with a grate to prevent accidental entry thereinto.

A method of controlling an overflow system 100 for a recreational pool 102 includes mounting a drain 104 to a bottom of the recreational pool 102 and extending a drain pipe 108 substantially horizontally from the drain 104 under the perimeter wall 106 to outside the boundary. The method also includes positioning a standpipe 118 outside the perimeter wall 106. The standpipe 118 has a first end and an open second end 122 where the first end is coupled to the drain pipe 108 and the second open end 122 of the standpipe 118 has an overflow elevation set between the normal water level elevation 120 for the recreational pool 102 and the top of wall elevation. The method also includes coupling a recirculation pipe 114 having a first end in fluid communication with the recreational pool 102 and a second end in fluid communication with the standpipe 118 proximate the second open end 122. In addition, the method includes circulating water from the recreational pool 102 to the standpipe 118 and through the drain pipe 108 back to the recreational pool 102 using the recirculation pipe 114. As explained above, the circulation prevents stagnation of the water in the drain pipe 108 when a water level in the recreational pool 102 is at the normal water level or below and not overflowing.

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that modifications and embodiments are intended to be included within the scope of the appended claims.

The invention claimed is:

1. An overflow system for a recreational pool, the overflow system comprising:

a drain configured to be mounted to a bottom of the recreational pool;

a drain pipe configured to extend substantially horizontally from the drain under a perimeter wall defining a boundary of the recreational pool to outside the boundary;

a standpipe configured to be positioned outside the boundary and having a first end and an open second end, the first end coupled to the drain pipe and the second open end having an overflow elevation between a normal water level elevation for the recreational pool and a top of wall elevation of the perimeter wall; and a recirculation pipe having a first end in fluid communication with the recreational pool and a second end in fluid communication with the standpipe proximate the second open end.

2. The overflow system of claim 1, wherein the recirculation pipe is configured to cause water to circulate from the recreational pool to the standpipe and through the drain pipe back to the recreational pool to prevent stagnation of the water in the drain pipe when a water level in the recreational pool is at the normal water level or below.

3. The overflow system of claim 1, wherein the system is configured to cause the water from the recreational pool to flow through the drain pipe and out the second end of the standpipe that is positioned outside of the boundary of the recreational pool when the water level in the recreational pool rises above the normal water elevation.

4. The overflow system of claim 1, wherein the perimeter wall may be sloped.

5. The overflow system of claim 1, further comprising a pump in fluid communication with the recirculation pipe and configured to pump water from the recreational pool to the standpipe.

6. The overflow system of claim 1, further comprising an overflow basin housing the standpipe.

7. The overflow system of claim 6, further comprising a discharge pipe in fluid communication with the overflow basin.

8. The overflow system of claim 1, wherein a diameter of the drain pipe increases from the drain to the first end of the standpipe.

9. The overflow system of claim 1, wherein the drain is flush to the bottom of the recreational pool.

10. The overflow system of claim 1, wherein the water in the recreational pool is disinfected water suitable for swimming.

11. The overflow system of claim 1, further comprising a chemical feed in fluid communication with the recirculation pipe and configured to treat the water circulating through the drain pipe back to the recreational pool.

12. A recreational pool comprising:

a perimeter wall defining a boundary for the recreational pool, the perimeter wall having a top of wall elevation above a normal water level elevation of the recreational pool; and an overflow system comprising, a drain mounted to a bottom of the recreational pool;

a drain pipe extending substantially horizontally from the drain under the perimeter wall to outside the boundary;

a standpipe positioned outside the perimeter wall and having a first end and an open second end, the first end coupled to the drain pipe and the second open end of the standpipe having an overflow elevation between the normal water level elevation for the recreational pool and the top of wall elevation; and a recirculation pipe having a first end in fluid communication with the recreational pool and a second end in fluid communication with the standpipe proximate the second open end.

13. The recreational pool of claim 12, wherein the recirculation pipe is configured to cause water to circulate from the recreational pool to the standpipe and through the drain pipe back to the recreational pool to prevent stagnation of the water in the drain pipe when a water level in the recreational pool is at the normal water level or below.

14. The recreational pool of claim 12, wherein the system is configured to cause the water from the recreational pool to flow through the drain pipe and out the second end of the standpipe that is positioned outside of the boundary of the recreational pool when the water level in the recreational pool rises above the normal water elevation.

15. The recreational pool of claim 12, wherein the perimeter wall is one of sloped or substantially vertical.

16. The recreational pool of claim 12, further comprising a pump in fluid communication with the recirculation pipe and configured to pump water from the recreational pool to the standpipe.

17. The recreational pool of claim 12, further comprising an overflow basin housing the standpipe.

18. The recreational pool of claim 17, further comprising a discharge pipe in fluid communication with the overflow basin.

19. The recreational pool of claim 12, further comprising a chemical feed in fluid communication with the recirculation pipe and configured to treat the water circulating through the drain pipe back to the recreational pool.

20. A method of controlling an overflow system for a recreational pool, the recreational pool comprising a perimeter wall defining a boundary and having a top of wall elevation above a normal water level elevation of the recreational pool, the method comprising:

mounting a drain to a bottom of the recreational pool;

extending a drain pipe substantially horizontally from the drain under the perimeter wall to outside the boundary;

positioning a standpipe outside the perimeter wall, the standpipe having a first end and an open second end wherein the first end is coupled to the drain pipe and the second open end of the standpipe has an overflow elevation set between the normal water level elevation for the recreational pool and the top of wall elevation;

coupling a recirculation pipe having a first end in fluid communication with the recreational pool and a second end in fluid communication with the standpipe proximate the second open end; and circulating water from the recreational pool to the standpipe and through the drain pipe back to the recreational pool using the recirculation pipe to prevent stagnation of the water in the drain pipe when a water level in the recreational pool is at the normal water level or below.

* * * * *